US009561636B2

(12) United States Patent
Diehr et al.

(10) Patent No.: US 9,561,636 B2
(45) Date of Patent: Feb. 7, 2017

(54) DEVICE FOR ADJUSTING COMPONENTS OF FOLDING-BOX GLUING MACHINES FOR SAFE OPERATION

(71) Applicant: HEIDELBERGER DRUCKMASCHINEN AG, Heidelberg (DE)

(72) Inventors: Wolfgang Diehr, Grevenbroich (DE); Markus Donges, Ludwigshafen (DE); Andreas Geider, St. Leon-Rot (DE); Uwe Hartstock, Nettetal (DE); Michael Rehberg, Speyer (DE); Frank Schmid, Krefeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 841 days.

(21) Appl. No.: 13/853,210

(22) Filed: Mar. 29, 2013

(65) Prior Publication Data

US 2013/0255573 A1 Oct. 3, 2013

(30) Foreign Application Priority Data

Mar. 29, 2012 (DE) ..... 10 2012 006 274

(51) Int. Cl.

| | |
|---|---|
| ***G06F 7/00*** | (2006.01) |
| ***B31B 1/74*** | (2006.01) |
| ***B31B 5/00*** | (2006.01) |

(52) U.S. Cl.

CPC . *B31B 1/74* (2013.01); *B31B 5/00* (2013.01); *B31B 2201/95* (2013.01); *B31B 2203/003* (2013.01)

(58) Field of Classification Search

None

See application file for complete search history.

(56) References Cited

U.S. PATENT DOCUMENTS

| | | | | |
|---|---|---|---|---|
| 4,262,582 | A | 4/1981 | Sugimoto et al. | |
| 4,604,083 | A * | 8/1986 | Barny | B31B 1/74 493/28 |
| 4,812,842 | A * | 3/1989 | Bayerlein | B41F 33/00 101/219 |
| 5,104,365 | A | 4/1992 | Sone et al. | |

(Continued)

FOREIGN PATENT DOCUMENTS

| | | |
|---|---|---|
| CN | 101177064 A | 5/2008 |
| CN | 201552778 U | 8/2010 |

(Continued)

OTHER PUBLICATIONS

German Patent and Trademark Office Search Report, dated Dec. 5, 2012.

*Primary Examiner* — Yolanda Cumbess

(74) *Attorney, Agent, or Firm* — Laurence A. Greenberg; Werner H. Stemer; Ralph E. Locher

(57) ABSTRACT

A device for adjusting components of a printing material processing machine, in particular a folding-box gluing machine, includes at least one group of processing stations which have an associated operating element and a remote control as well as a safety-path computer and an operating-path computer. A first step for initiating an adjustment process of the components is carried out by a common signal transmitter both when operating a switch on the machine and when operating the remote control.

12 Claims, 2 Drawing Sheets

(56) References Cited

U.S. PATENT DOCUMENTS

| | | | | |
|---|---|---|---|---|
| 7,402,129 | B2 | 7/2008 | Diehr | |
| 8,973,499 | B2 | 3/2015 | Klüpfel et al. | |
| 2010/0058943 | A1* | 3/2010 | Bober | B31B 1/74 101/32 |
| 2012/0035032 | A1* | 2/2012 | Decker | B65H 9/14 493/18 |

FOREIGN PATENT DOCUMENTS

| | | | |
|---|---|---|---|
| CN | 202016223 | U | 10/2011 |
| DE | 690 15 638 | T2 | 8/1995 |
| DE | 10 2011 118 283 | A1 | 9/2012 |
| EP | 0133823 | A1 | 3/1985 |
| GB | 2144368 | A | 3/1985 |

* cited by examiner

DEVICE FOR ADJUSTING COMPONENTS OF FOLDING-BOX GLUING MACHINES FOR SAFE OPERATION

CROSS-REFERENCE TO RELATED APPLICATION

This application claims the priority, under 35 U.S.C. §119, of German Patent Application DE 10 2012 006 274.5, filed Mar. 29, 2012; the prior application is herewith incorporated by reference in its entirety.

BACKGROUND OF THE INVENTION

Field of the Invention

The present invention relates to a device for adjusting components in a printing material processing machine, in particular a folding-box gluing machine, including at least one group of processing stations having an associated operating element and a remote control as well as a safety-path computer and an operating-path computer.

Folding-box gluing machines are long, complex machines that include a large number of processing stations. In a folding-box gluing machine, folding boxes are produced out of blanks, for example printed sheets. That process requires a large number of processing steps to transform the sheet-shaped printing material into a folded box. For that reason, folding-box gluing machines include a number of processing stations disposed in line and connected to each other by transporting stations. The processing stations fold and glue the sheet-shaped printing material until in the end a glued and folded box leaves the machine.

Such a folding-box gluing machine is known, for example, from U.S. Pat. No. 7,402,129 B2. In order to be able to operate a folding-box gluing machine, corresponding settings must be made on various components of the folding-box gluing machine. Among those components are, for example, roller cheeks for format adjustment. Since the folding-box gluing machines are very long, the individual processing stations are generally combined in groups that may be operated together. An operator may operate a group of processing stations together on the machine to make the required settings, such as format changes, in that way.

Furthermore, it is known to use a wireless remote control to be more flexible in terms of the operation of the machine. However, when the components to be adjusted are not within the visible range of the operator, the initiation of adjustment operations on the components to be adjusted may be hazardous. Since folding-box gluing machines include a plurality of adjustable components, those machines are not completely encased and only have individual safety measures for specific areas. In order to keep the risk of operator injury within acceptable limits, steps need to be taken to ensure that when an operator makes adjustments to a folding-box gluing machine, those adjustments are within the operator's visible range so that the operator monitors the potentially hazardous adjustment.

SUMMARY OF THE INVENTION

It is accordingly an object of the invention to provide a device for adjusting components of folding-box gluing machines for safe operation, which overcomes the hereinafore-mentioned disadvantages of the heretofore-known devices of this general type and which increases a level of safety during an adjustment of components of a machine for processing printing material, in particular a folding-box gluing machine, and at the same time allows convenient operation of the machine by remote control and operating elements on the machine.

With the foregoing and other objects in view there is provided, in accordance with the invention, a device for adjusting a printing material processing machine, in particular a folding-box gluing machine. The device comprises at least one group of processing stations having components to be adjusted, an associated switch disposed at the machine and a remote control as well as a safety-path computer and an operating-path computer. A common signal transmitter is configured to take a first step toward initiating an adjustment process of the components by operating the switch at the machine and operating the remote control.

The present invention is particularly suitable for adjusting components in a folding-box gluing machine. However, in principle, it may be used on any other processing machine that includes a plurality of processing stations and also has the problem that hazardous adjustments to components are not completely screened off, thus requiring visual contact during an adjustment process.

In accordance with the present invention, multiple processing stations of the machine are assigned to a group, with each group of processing stations having an associated operating element, e.g. a switch. Operators may use this operating element to make adjustments of components directly on the machine. Furthermore, a remote control is provided that may likewise be used to adjust the same components in the machine. In principle, the remote control and the operating element of one group on the machine initiate the same adjustment operation. Moreover, an operating path computer and a safety path computer are provided to control the machine. The safety path computer and the operating path computer are set up to be redundant to ensure that when the operating path computer fails or malfunctions, the machine can be brought to a safe state and no uncontrolled conditions arise on the machine. This is an important feature especially for folding-box gluing machines in which components to be adjusted may be hazardous to the operator, potentially causing injury in the form of bruises or the like.

In accordance with the present invention, the first step of initiating the process of adjusting the components is done by a common signal transmitter no matter whether the initiation occurs by using the switch provided on the machine or by using the remote control. This means that it is always the same signal transmitter that makes the first step to initiate a potentially hazardous adjustment process, no matter whether the operator has initiated the adjustment process using the switch on the machine or using the remote control. This means that it is always the same signal transmitter that takes the very first step to initiate a potentially hazardous adjusting process, no matter whether the operator has initiated the adjusting process using the switch on the machine or using the remote control. A considerable advantage of this aspect is that independently of the selection of the operating element for adjusting the components, the initiation of the adjusting process proceeds uniformly.

In accordance with another preferred feature of the invention, the signal transmitter is the switch of the at least one group of processing stations. In accordance with this embodiment, the switch on the machine has a double function. On one hand, the switch can be used to initiate the adjusting process of the components directly on the machine. On the other hand, it acts as the signal transmitter for the initiation of the adjustment of the components even when the remote control is used. This is preferably achieved by configuring the switch in such a way that in a first position, the switch is provided for making the adjustment using the remote control and in a second position, the switch is provided for making the adjustment of the components on the machine. In both positions one and the same switch acts as the signal transmitter to initiate the adjusting process, no matter whether in the further course of events the adjusting process is controlled by the switch on the machine or by the remote control. The signal of the transmitter is then transmitted to the safety computer, which causes the adjusting process to be released.

In accordance with an added advantageous feature of the invention, after actuation of the switch in the first position, a window of time, in particular 60 seconds, starts preferably on the operating path computer. This window of time, which is to be relatively short, acts like a timer function, to ensure that the operator cannot get too far away from the group to be adjusted on the machine while the adjustment process is made using the remote control. When the operator does not make the adjustment on the machine by using the remote control within the specified window of time, the adjusting process is blocked and the operator needs to re-initiate the adjusting process. This is a way to ensure that the operator will actually be at least in the vicinity of the group to be adjusted at all times and that the operator has an eye on the potentially hazardous area during the adjustment of the components. Furthermore, this feature ensures that the operator will not turn away and leave the remote control to be operated by another person once the adjusting process has been initiated. When the operator is away for more than 60 s, the adjusting process has to be re-started from the beginning.

In accordance with an additional feature of the invention, the adjusting process is accomplishable by using the remote control. For this purpose, the operator may move the corresponding components of the selected group into position by using operating elements such as keys on the remote control. For safety reasons, i.e. to prevent any accidental operation of the keys, this may only be done by two-key commands, which means that the operator needs to operate two keys simultaneously, with one key being detected by the safety-path computer and one by the operating-path computer to ensure the required redundancy.

In accordance with yet another feature of the invention, for safety reasons, at least one of the two computers stops the adjusting movement of the group when one operating element on the remote control for the adjustment of the respective group is released. Once the operator releases one of the two keys for adjusting the components on the respective group, the adjusting process is stopped immediately by the computer associated with the released key to avoid third-party injuries. In order to continue the adjusting process, the operator needs to continue the adjusting process within a window of time of 60 seconds, for example, because for safety reasons, once the 60 seconds have passed, the switch on the machine will have to be re-set into the first position.

In accordance with yet a further feature of the invention, upon operation of the adjusting process by using the remote control, the operating path computer stops the movements of the adjusting process when a predetermined desired position for the adjusting process is reached at the latest. This is a way to ensure that the predetermined target positions of the components to be adjusted are reliably reached and that the operator cannot overshoot the mark even if he or she continues to press the operating elements on the remote control. This may additionally be indicated visually in that the switch on the machine may begin to flash, for example, so that the operator may be sure that the position has actually been reached and that the adjusting process has not been terminated prematurely due to a blocking of the machine.

In accordance with yet an added feature of the invention, the predetermined target positions are preferably calculated from job data in a superordinate control panel computer, which at least communicates with the operating path computer. Based on inputs made by the operators or on a job that was transmitted electronically, the control panel calculates the target positions for the machine components to be adjusted in order to be able to correctly process the job. The target positions that have been calculated in this way and may be implemented using the wireless remote control or the switch on the machine, are then transmitted to the operating path computer.

In accordance with yet an additional feature of the invention, the adjusting process begins when the switch is in the second position and stops when the switch is released. When the switch is in the second positions, the adjustment of the components cannot be achieved using the remote control but only by the switch on the respective group of the machine. For this purpose, the switch is preferably constructed as a rotary switch that returns to a neutral position when it is released. As soon as the operator releases the switch in the second position, the operating path computer stops the adjusting process to ensure that the operator is present at the switch during the adjusting process.

In accordance with a concomitant advantageous feature of the invention, the adjusting process stops when a predetermined target position of the adjusting process is reached. In analogy to the adjusting process by using the remote control, when the adjusting process is carried out by actuating the switch on the machine in the second position, it is ensured that the predetermined target positions are correctly reached. An overreaching of the predetermined target positions is avoided since the operating-path computer automatically terminates the adjusting process when the predetermined target position is reached even if the operator continues to hold the switch in the second position. In this case, a flashing of the switch may likewise indicate in an optical way that the target positions have been reached.

Thus, the present invention allows convenient operation of a folding-box gluing machine both at the machine and by using the remote control, ensuring that the predetermined target positions are accurately reached and at the same time ensuring that the operator will always be in the vicinity of the machine components to be adjusted and will keep an eye on the potentially hazardous adjusting process due to the safety concept.

Other features which are considered as characteristic for the invention are set forth in the appended claims.

Although the invention is illustrated and described herein as embodied in a device for adjusting components of folding-box gluing machines for safe operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
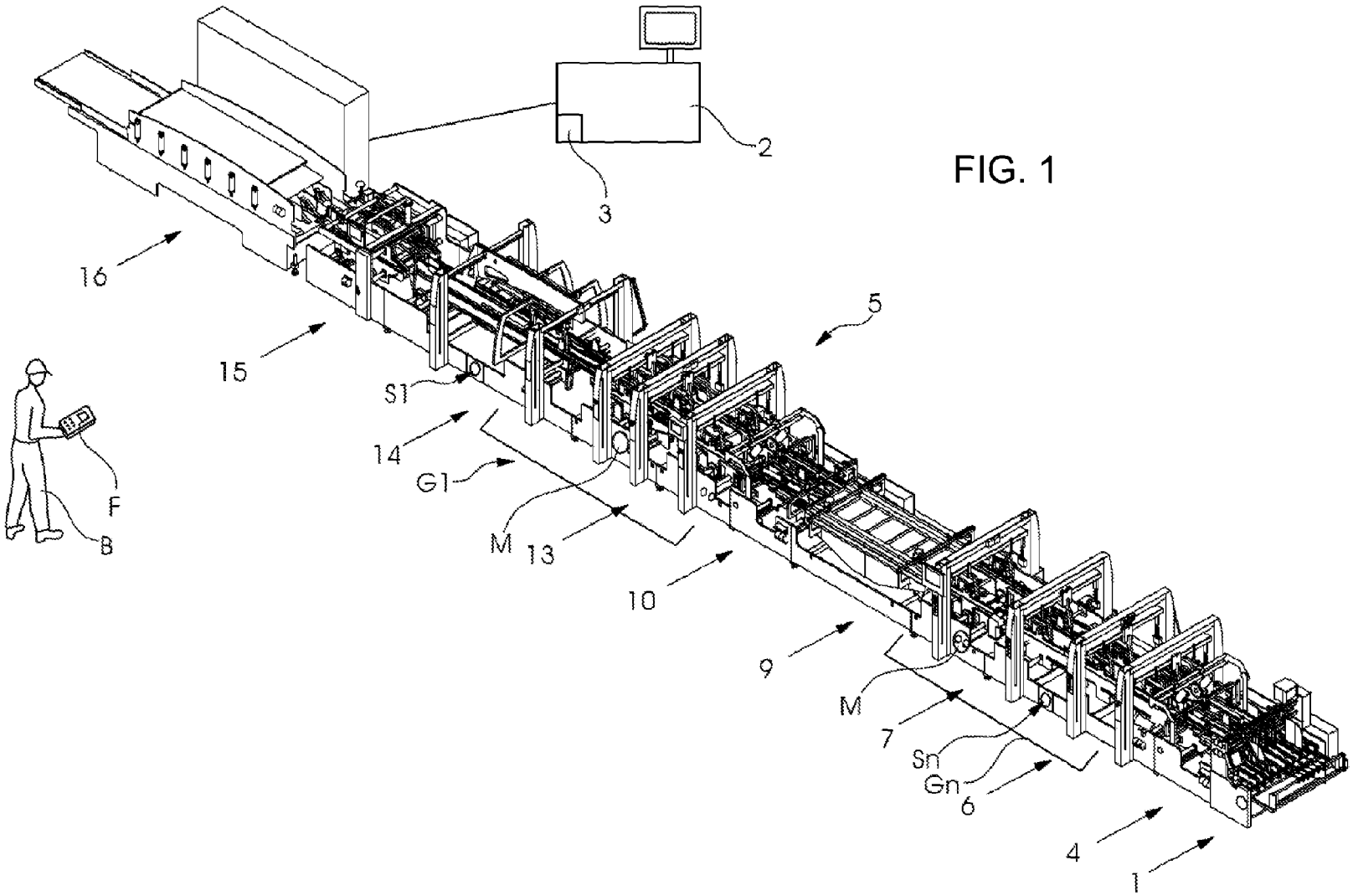
FIG. 1 is a diagrammatic, perspective view of a folding-box gluing machine including a device according to the invention for adjusting components.

Referring now to the figures of the drawings in detail and first, particularly, to FIG. 1 thereof, there is seen, by way of example, individual processing stations 4, 6, 7, 10, 13, 14 of a folding-box gluing machine 5. The folding-box gluing machine 5 shown in FIG. 1 starts on the right side at the bottom of the drawing with a feeder 1 that successively draws blanks to be processed off a stack and individually feeds them to a downstream processing station. The feeder 1 is followed by an alignment station 4 in which the blanks are individually aligned against a lateral stop. Machine components that are positionable in the transverse direction by an actuating drive and are constructed as two belt pairs, act as conveying elements for transport through the alignment station. The next stations are a pre-folding station 6 and a first folding module 7. Transversely positionable machine components that are constructed as belt pairs and are positioned in the transverse direction by an actuating drive as a function of the type of blank, guide the blanks through the pre-folding station 6 and through the folding module 7.

The folding module 7 is followed by a rotation unit 9. In order to rotate the blanks through a 90° angle about a vertical axis, the rotation unit 9 includes two conveying sections that are disposed to be parallel and adjacent each other and have speeds which are separately adjustable. The blanks rest on the two conveying sections and are rotated due to the different speeds of the two conveying sections. The two conveying sections include driven rollers as conveying elements.

The rotation unit 9 is followed by a further alignment station 10 which, in terms of construction, corresponds to the alignment station 4 following the feeder 1. Thus, it likewise contains conveying elements in the form of machine components that are positionable in the transverse direction and are constructed as conveying belt pairs.

The next processing station 13 is used to carry out processing operations that depend on the type of box. For example, further crease lines may be pre-folded or special types of folds may be created. Again, belts pairs that are positionable in the transverse direction by actuating drives are used as conveying elements for transport through the processing station 13.

The next processing station is a folding station 14 in which blank parts that have previously been provided with seams of glue are folded through 180°. The folding station 14 includes belt pairs as conveying elements and a glue application unit. Actuating drives may move the belt pairs and the glue application unit into their transverse position that is defined by the type of blank. A following transfer station 15 feeds the folded blanks, which still have non-set seams of glue, to a downstream collection and pressure device 16 with all parts in accurate alignment. The collection and pressure device 16 firstly creates a shingled stream of folded blanks and then subjects the shingled stream of blanks to pressure between conveying pressure belts for a certain amount of time to set the glue seams. The transfer station likewise contains belt pairs that are adjustable in the transverse direction by using actuating drives.

The folding-box gluing machine 5 shown in FIG. 1 includes a control panel computer 2, which allows an operator B of the machine to input target values for a new processing job. The control panel computer 2 may be integrated in the machine 5 or it may be disposed in a separate control console outside the machine 5 as shown in FIG. 1. Using a keyboard or a touch screen, the operator B may access pending print jobs and may have the target values calculated on the control panel 2. The target values for the adjustment of the components in the machine 5 are transmitted to the control of the machine 5 through a communication link.

Figure 2:
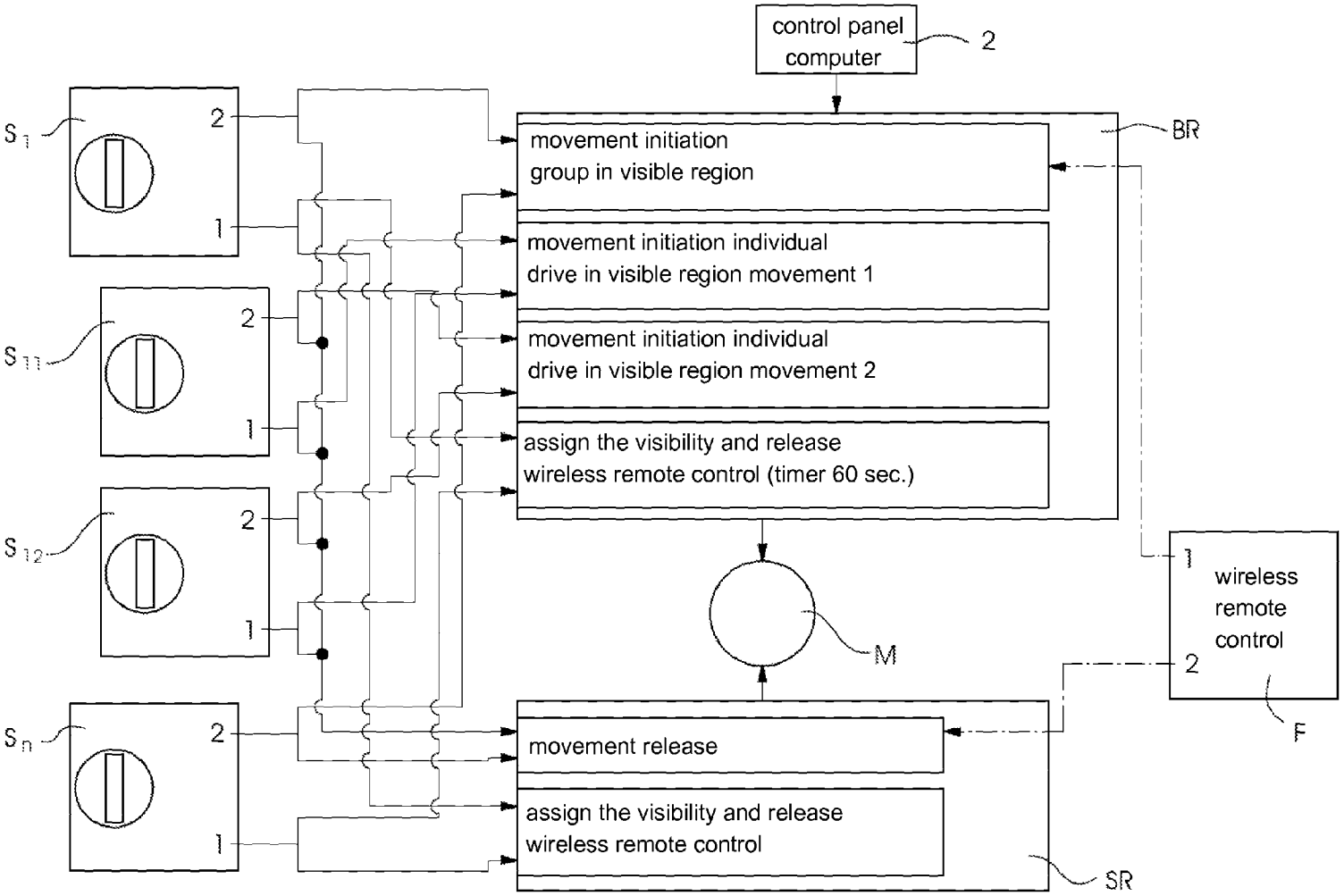
FIG. 2 is a wiring diagram illustrating a signal path of control components of the folding-box gluing machine that are involved.

The folding-box gluing machine 5 includes two groups of processing stations G1, Gn. At least one drive motor M and a respective rotary switch S1, Sn are assigned to each group. FIG. 1 only illustrates one motor M per group G1, Gn. In most cases, however, several motors M will be provided for each group Gn, G1, preferably one motor M for each station 9, 10, 13, 14. Individual switches $S_{11}$ and $S_{12}$ shown in FIG. 2 are used to separately adjust individual stations of a group G1, Gn and their motor M, allowing two respective movements such as left and right, up and down or forward and backward. The individual switches $S_{11}$ and $S_{12}$ are of no significance to the present invention. The folding-box gluing machine 5 furthermore includes a control formed of a safety computer SR and an operating-path computer BR. The operating-path computer BR receives setting values from the control panel computer 2 and may actuate the motors M of the groups G1, Gn in accordance with the setting values. The control panel computer 2 further includes a transceiver unit 3 that may communicate with a remote control F. In this way, the operator B may make adjustments to the folding-box gluing machine 5 not only by using the rotary switches S1, Sn, but also by using the remote control F.

The switches S1, Sn are constructed as so-called rotary switches. They are held in a neutral position by a spring force. However, other switches that are automatically set back to a neutral position may likewise be used. The operator B may rotate the rotary switches S1, Sn into a first position and into a second position. When the operator B releases the rotary switch S1, Sn, the rotary switch S1, Sn returns to the neutral position.

The folding-box gluing machine 5 and the processing stations thereof are provided substantially without encasing. Therefore, there may be hazards for people because there are only individual protective measures. For this reason, it is necessary to ensure that the respective group G1, Gn of processing stations that is to be adjusted remains within the visible range of the operator B, even if the operator B uses the remote control F, so that the operator B will notice if third persons are in danger.

FIG. 2 is a control diagram of the folding-box gluing machine 5. The control is basically formed of the operating-path computer BR and the safety computer SR. The operating-path computer BR additionally communicates with the superordinate control panel computer 2. The operator B may input or access box sizes on the control panel computer 2, which the control panel computer 2 uses to calculate target values for adjusting processes of the components of the groups G1, Gn. When the operator B intends to make adjustments to group G1, for example, he or she has two options: he or she can use the remote control F or the switch S1. In both cases, however, the first step of the adjusting process is initiated by the same signal transmitter, i.e. by the switch S1.

When the operator B rotates the switch to a position 1, he or she may subsequently use the remote control F. In this case, a corresponding signal is sent to the operating-path computer BR, which then starts a window of time of 60 seconds, for example. Within these 60 seconds, the operator B needs to initiate the movement of the components on the group G1 by pressing two keys on the remote control.

The actual adjusting process, i.e. the movement of the associated drive motors M, is initiated by the operator B by pressing the two keys on the remote control F. It is only if the operator B continues to hold down both keys on the remote control F that the motors M of group G1 will make the adjustment. When the two keys on the remote control F are pressed, a respective corresponding signal is sent to the operating-path computer BR and to the safety computer SR. Both computers BR, SR then release the movement of the motors M and the motors M may make the adjustment. Even if the operator B releases just one key, the movement will stop and the 60-second window of time will restart. If the keys on the remote control F are not operated within the 60-second period, the entire adjusting process needs to be restarted by using the switch S1 on the machine 5 once the window of time has passed. The two-key operation on the remote control F ensures that the operator B does not accidentally initiate a movement of the motors M. A movement is only possible when the operator deliberately holds both keys down. When the motors M have reached the target positions prescribed through the control panel computer 2, the motors M stop the movement and the adjusting process on the group G1 is completed. In addition, a light source that is integral to the switch S1 begins to flash so that the operator B can be sure that the target position has actually been reached.

Alternatively, the operator B may make the adjustment on group G1 directly on the folding-box gluing machine 5 by using the switch S1. In this case the operator rotates the switch S1 into position 2, causing corresponding signals to be sent to the operating-path computer BR and to the safety computer SR and the motors M of the stations of group G1 to be set in motion. As soon as the operator B releases the rotary switch S1 in a position 2, the motors M stop and the potentially hazardous movements during the adjusting process are stopped. In accordance with this alternative, the movement of the motor M during the adjusting process of group G1 will likewise stop as soon as the target positions defined by the control panel computer 2 are reached. In addition, the switch S1 starts to flash.

Once the adjusting process on group G1 is completed, the operator B may move on to the next group Gn to make corresponding adjustments, for example to roller flanks. As was the case with Group G1, for group Gn, the operator B may likewise choose between using the remote control F or the switch Sn in position 2. In this way the operator B may successively adjust all groups G1, Gn of processing stations and may then switch the folding-box gluing machine 5 to production on the control panel computer 2. The device according to the invention ensures that during the adjusting processes, the operator B will always be in the vicinity of the group G1, Gn to be adjusted even when he or she uses the remote control F and thus will keep an eye on potential hazards.

The invention claimed is:

1. A device for adjusting a printing material processing machine, the device comprising:

at least one group of processing stations having components to be adjusted;

a switch disposed at the machine and associated with said at least one group of processing stations;

a safety-path computer and an operating-path computer associated with said at least one group of processing stations;

a remote control associated with said at least one group of processing stations, said remote control having operating elements and being configured to cause at least one of said computers to stop an adjusting movement of a respective one of said at least one group of processing stations when one of said operating elements on said remote control for adjustment of said respective group is released; and a signal transmitter configured to take a first step toward initiating an adjustment process of said components by either operating said switch at the machine or operating said remote control.

2. The device according to claim 1, which further comprises a superordinate control panel computer communicating at least with said operating path computer and configured to input or access a job and to calculate target positions for said adjusting movements in said respective group.

3. The device according to claim 1, wherein the printing material processing machine is a folding-box gluing machine.

4. The device according to claim 1, wherein upon actuation of said adjustment process by using said remote control, said operating-path computer stops a movement of said adjustment process at the latest upon reaching a predetermined target position for said adjustment process.

5. A device for adjusting a printing material processing machine, the device comprising:

at least one group of processing stations having components to be adjusted;

a switch disposed at the machine and associated with said at least one group of processing stations;

a remote control associated with said at least one group of processing stations;

a safety-path computer and an operating-path computer associated with said at least one group of processing stations; and a signal transmitter configured to take a first step toward initiating an adjustment process of said components by either operating said switch at the machine or operating said remote control; and upon actuation of said adjustment process by using said remote control, said operating-path computer stopping a movement of said adjustment process at the latest upon reaching a predetermined target position for said adjustment process.

6. A device for adjusting a printing material processing machine, the device comprising:

at least one group of processing stations having components to be adjusted;

a switch disposed at the machine and associated with said at least one group of processing stations;

a remote control associated with said at least one group of processing stations;

a safety-path computer and an operating-path computer associated with said at least one group of processing stations; and a signal transmitter being said switch of said at least one group of processing stations, said signal transmitter configured to take a first step toward initiating an adjustment process of said components by either operating said switch at the machine or operating said remote control, said switch having a first position for carrying out said adjustment process of said components using said remote control and a second position for carrying out said adjustment process of said components at the machine wherein, operation of said switch in said second position starts said adjustment process and releases said switch causing at least one of said computers to stop said adjustment process.

7. The device according to claim 6, wherein said switch is configured to start a window of time after actuation of said switch in said first position.

8. The device according to claim 7, wherein said window of time is 60 seconds.

9. The device according to claim 7, wherein said window of time is started on said operating-path computer.

10. The device according to claim 7, wherein said remote control is configured to implement said adjustment process.

11. The device according to claim 6, wherein said operating-path computer stops said adjustment process upon reaching a predetermined target position of said adjustment process.

12. The device according to claim 11, wherein an optical signal is given upon reaching said predetermined target position.

* * * * *